United States Patent [19]

Toyama

[11] Patent Number: 4,979,919

[45] Date of Patent: Dec. 25, 1990

[54] METHOD AND APPARATUS FOR MANUFACTURING CATHODE-RAY TUBES

[75] Inventor: Noboru Toyama, Mobara, Japan

[73] Assignee: Hitachi, Ltd., Tokyo, Japan

[21] Appl. No.: 509,210

[22] Filed: Apr. 16, 1990

Related U.S. Application Data

[63] Continuation of Ser. No. 193,047, May 12, 1988, abandoned.

[30] Foreign Application Priority Data

May 15, 1987 [JP] Japan ..... 62-116802

[51] Int. Cl.[5] ..... H01J 9/38

[52] U.S. Cl. ..... 445/57; 445/45; 445/25

[58] Field of Search ..... 445/25, 45, 43, 44, 445/52, 40, 57, 65, 66; 432/10, 225, 226; 65/36

[56] References Cited

U.S. PATENT DOCUMENTS

| | | | |
|---|---|---|---|
| 2,824,364 | 2/1958 | Bovenberk | 445/25 |
| 2,856,174 | 10/1958 | Daley et al. | 432/226 |
| 3,732,061 | 5/1973 | Hackley | 432/226 |
| 3,894,858 | 7/1975 | Rogers | 445/45 |
| 3,912,482 | 10/1975 | La Grouw et al. | 445/45 |
| 4,204,721 | 5/1980 | Hubert et al. | 445/25 |
| 4,498,884 | 2/1985 | Stöver et al. | 445/45 |

FOREIGN PATENT DOCUMENTS

| | | | |
|---|---|---|---|
| 076786 | 10/1980 | U.S.S.R. | 445/57 |

*Primary Examiner*—Kurt Rowan

*Attorney, Agent, or Firm*—Antonelli, Terry, Stout & Kraus

[57] ABSTRACT

This invention relates to a method of and an apparatus for baking the silicate films, which are formed on the front glass panels of cathode-ray tubes by a spraying or coating operation, so as to fix the films stably to the front glass panels. The front glass panels only, which are positioned in opposition to infrared ray radiation panels provided in the upper portion of a heating furnace body, are heated with the radiant heat from the infrared ray radiation panels. The radiant heat-screening isolation plates are provided between the front glass panels and funnels, and at least a part, which is below these isolation plates, of the furnace body is opened or cooled.

7 Claims, 2 Drawing Sheets

METHOD AND APPARATUS FOR MANUFACTURING CATHODE-RAY TUBES

This is a continuation of application Ser. No. 193,047, filed May 12, 1988 now abandoned.

BACKGROUND OF THE INVENTION:

This invention relates to a method and an apparatus for manufacturing cathode-ray tubes, and more ticularly to a method and an apparatus for manufacturing cathode-ray tubes, in which a front film such as silicate film formed on a front glass panel of a cathode-ray tube by a spraying or coating operation is baked so as to be fixed to the front glass panel.

In order to bake a silicate film in this manner, it is generally necessary that the cathoderay tube be heated to not lower than 100° C. In such a case, a furnace (generally called "a tunnel furnace") shown in FIG. 1 is employed in a conventional method of this kind. A furnace body 1 consists of an outer furnace frame 2 and an inner furnace frame 3. In a hot air circulating passage 4 between these outer and inner furnace frames 2, 3, a fan 5 and a heater 6 are provided in the upper and side portions, respectively, thereof. The cathode-ray tubes 7 are retained by holders (not shown) and transferred in the inner furnace frame 3 in the furnace body 1.

An apparatus of this kind is also disclosed in, for example, U.S.P. No. 4,350,514 which is corresponded to Japanese Patent Laid-Open No. 162451/1981.

The apparatus disclosed in this publication has a construction as shown in FIG. 2. This drawing is a sectional view of a heating furnace in the apparatus. In this furnace, a hot heating air (which will hereinafter be called "furnace air") is sucked by a fan 5 and sent into an inner shell 3 from the ceiling thereof and the lower side of a mesh belt 26 through a hot air circulating duct 4. This arrangement is used generally in practice so as to set a uniform temperature distribution in the furnace, and the fan 5 is called a side fan. This fan is provided on the ceiling in some cases (refer to FIG. 1). Reference numeral 28 denotes an external air supply pipe, which is disposed so that hot air can be sent into the duct 4 through the interior of an outer shell 2. The external hot air enters the furnace from the external air supply pipe 28, and is mixed with the furnace air, the resultant mixed air being blown in a heated state into the inner shell 3 through air vents 30. Reference numeral 7 denotes cathode-ray tubes, 22 a suction duct, 23 discharge ports for returning the furnace air to the interior of the duct 4, 24 a motor for driving the fan 5, and 21 a flow meter for measuring the flow rate of the external air.

In a tunnel furnace used in a convection heating method according to the above conventional techniques, it is necessary that a cathode-ray tube as a whole be inserted in the tunnel furnace and heated so as to circulate the hot air in the furnace. If these requirements are met, not only a front glass panel but also other parts of the cathode-ray tube, such the funnel glass is heated.

In order to secure the strength of a silicate film formed on the front glass panel, the film has to be baked at a temperature of not lower than 130° C. However, a cathode-ray tube has two portions which are not heat resistant. One of these two portions is a base of a plastic material, and the other a gas (such as $H_2O$, CO, $CO_2$, etc.) deposited on the inner surface of the cathode-ray tube.

The base is made of plastic materials. If the base is left in the atmosphere of 130° C. for a long period of time (for example, thirty minutes), it is generally melted. When the gas deposited on the inner surface of the cathode-ray tube is heated, it leaves the inner surface, to cause the pressure in the cathode-ray tube to be momentarily higher. The resultant gas is deposited on the surface of the cathode and contaminates it, so that the electron emission capacity of the cathode lowers.

As mentioned above, in the so-called tunnel furnace used in a conventional convection heating method, the temperature of the front glass panel cannot be increased to a required level during a baking operation, whereby the strength of the silicate film cannot be secured.

SUMMARY OF THE INVENTION:

An object of the present invention is to provide a method of and an apparatus for manufacturing cathode-ray tubes in which the strength of the silicate films formed thereon can be secured satisfactorily without causing any adverse effect on the cathode-ray tubes. To achieve this object, the present invention employs a method of heating only the front glass panel of the cathode-ray tube (which will hereinafter be referred to as "front glass panel") with radiant heat of infrared rays or far infrared rays (which will herein after be generally referred to as "infrared rays"), an infrared panel provided in opposition to the front glass panel, and a radiant heat isolating plate provided between the glass panel and a funnel.

Figure 1:
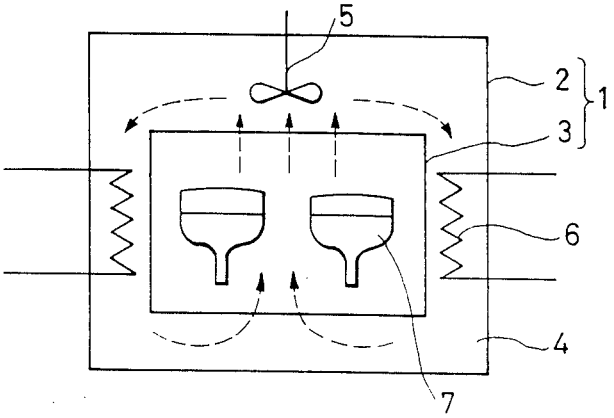
FIG. 1 PRIOR ART
FIG. 1 is a schematic view illustrating an operation of an apparatus used in a conventional method of manufacturing cathode-ray tubes.
Figure 2:
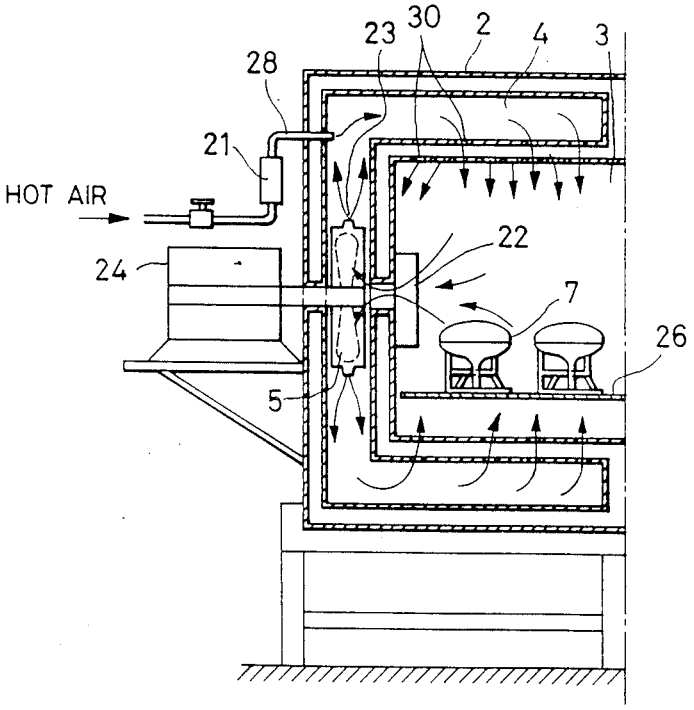
FIG. 2 PRIOR ART
FIG. 2 is a diagram showing the general construction and operation of a conventional apparatus for manufacturing cathode-ray tubes.

DESCRIPTION OF THE PREFERRED EMBODIMENT:

The present invention has been developed so as to eliminate the above-mentioned drawbacks encountered in the conventional techniques of this kind, and relates to a method of heating a front panel alone with the radiant heat of infrared rays, and an apparatus for practicing this method.

The radiant heat of infrared rays or far infrared rays heat only the front glass panel, to which the infrared rays or far infrared rays are applied. Accordingly, a silicate film on the panel can be baked, and the temperature of the funnel does not increase. This enables the strength of the silicate film to be improved, the deformation of a base, which consists of a plastic material, to be prevented, and the discharging of a gas from the inner surface of the cathode-ray tube to be avoided.

An embodiment of the present invention will now be described with reference to FIG. 3. A furnace body 10 is opened at its lower side, and conveyors 11 are provided in the opened portion of the furnace body 10. A carrier 13 for retaining cathode-ray tubes 12 is placed on the conveyors 11. Isolation plates 14 arranged so as to surround the outer circumferences of the upper portions of the funnels 12*a* of the cathode-ray tubes 12 are fixed to the carrier 13. In the upper portion of the interior of the furnace body 10, for example, plate type infrared ray radiation panels 15 are provided in opposition to the front glass panels 12*b* of the cathode-ray tubes 12.

When the carrier 13 retaining the cathode-ray tubes 12 thereon is transferred by the conveyors 11 in the furnace body 10, the front glass panels 12*b* are heated with the infrared rays from the infrared ray radiation panels 15, so that the silicate films formed on the front glass panels 12*b* are baked sufficiently. During this time, the funnels 12*a* are screened from the radiant heat of the infrared rays by the isolation plates 14 which consist, for example, of stainless steel. Accordingly, the funnels 12*a* are not heated. For example, even when the temperature of the front glass panels 12*b* is increased to a required level of 150° C., the temperature of the funnels 12*a* can be controlled to be not higher than 80° C.

In this connection, when the temperature of the front glass panels 12*b* is increased to, for example, 130° C. ~200° C., the temperature of the relative funnels 12*a* can be maintained at not higher than 60° C. ~100° C.

Since the funnels 12*a* are not heated as mentioned above, the temperature of the front glass panels 12*b* can be increased to not lower than 130° C. which is required to secure a sufficient strength of the silicate films. However, if the temperature of the front glass panels 12*b* is increased to greater than 200° C., the front glass panels 12*b* are thermally expanded, while the funnels 12*a* are not. Consequently, thermal stress occurs at the joint portions between the front glass pannels 12*b* and funnels 12*a* to cause the cathode-ray tubes 12 to be broken. Therefore, it is necessary that the temperature at which the front glass panels 12*b* are heated be set to 130° C.~200° C.

Since the funnels 12*a* are not heated, the deformation of the bases can be prevented, and the discharging of the gas from the inner surfaces of the cathode-ray tubes 12 can be minimized. Therefore, the gas-contaminating of the cathodes, which causes the deterioration of the electron emission capacity of the cathodes, can be prevented.

According to the present invention, the front glass panel only is heated, and the strength of the silicate film is improved. Moreover, the thermal deformation of the base, and the gas-contaminating of the cathode, which causes the therein radiating capacity thereof to be deteriorated, can be prevented.

Figure 3:
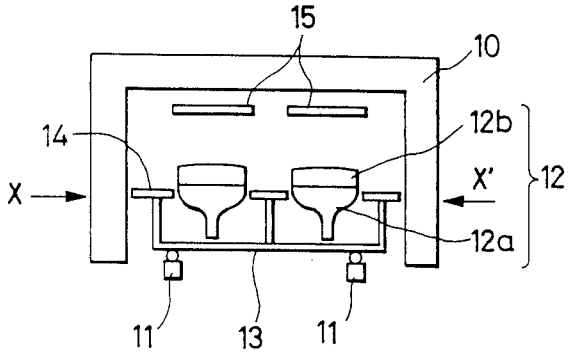
FIG. 3 is a diagram showing an example of the basic construction of an embodiment of the apparatus according to the present invention.
Figure 4:
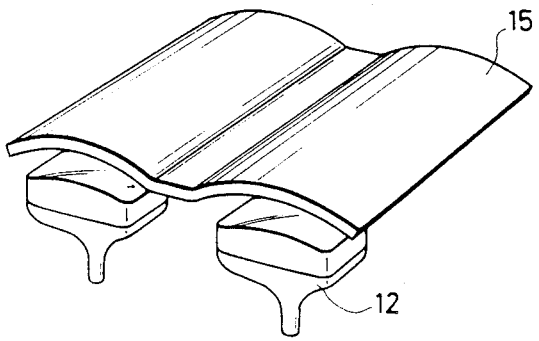
FIG. 4 is a diagram showing an example of the construction of a current type infrared ray radiating unit.

If the infrared ray radiation unit 15 (FIG. 3) consists of curved panels as shown in FIG. 4, excellent effects are achieved to obtain uniform temperature distribution of the front glass panel.

If at least a portion of the part of the furnace body 10 shown in FIG. 3 which is not higher than the line X—X' corresponding to the position of the isolation plates 14 is opened or cooled as usual way by a cooler (not shown), the temperature of the funnel can, of course, be reduced.

What is claimed is:

1. A method of manufacturing cathode-ray tubes, comprising the steps of supporting cathode-ray tubes having a funnel portion and a front glass panel with a front film thereon, and baking front films formed on the front glass panels of said cathode-ray tubes to fix said front films to said front glass panels, wherein the step of baking is carried out by heating only said front glass panels with the radiant heat of infrared rays utilizing heat-screening insulation plates provided between said front glass panel and said funnel portion to prevent radiant heat from an infrared ray radiant unit from being transmitted to said funnel portion.

2. A method of manufacturing cathode-ray tubes according to claim 1, wherein the temperature at which said front glass panels are heated is 130° C.~200° C.

3. An apparatus for manufacturing cathode-ray tubes, wherein front films formed on front glass panels of cathode-ray tubes are baked to fix said front films to said front glass panels, comprising a furnace body at least a part of which is opened, conveyors, a carrier retaining cathode-ray tubes and adapted to be transferred by said conveyors, an infrared ray radiation unit provided in a position opposed to said front glass panels of said cathode-ray tubes retained by said carrier, and radiant heat-screening isolation plates provided between said front glass panels and funnels of said cathode-ray tubes to prevent the radiant heat from said infrared ray radiation unit from being transmitted to said funnels.

4. An apparatus for manufacturing cathode ray tubes according to claim 3, wherein said cathoderay tubes are retained by said carrier with such construction that said front glass panels are positioned on the upper side with said funnels on the lower side, said infrared ray radiation unit being provided in the upper portion of said furnace body to be opposed to said front glass panels.

5. An apparatus for manufacturing cathode-ray tubes according to claims 3 or 4, wherein said furnace body is opened at least at a part thereof which is lower than said radiant heat-screening isolation plates.

6. An apparatus for manufacturing cathode-ray tubes according to claim 3 or 4, wherein at least a part thereof which is lower than said radiant heat-screening isolation plates is cooled by cooling means.

7. An apparatus for manufacturing cathode-ray tubes according to claim 3 or 4, wherein said isolation plates are fixed to said carrier.

* * * * *